US007933710B2

(12) United States Patent
Tanaka et al.

(10) Patent No.: US 7,933,710 B2
(45) Date of Patent: Apr. 26, 2011

(54) ABNORMALITY DIAGNOSIS DEVICE OF INTERNAL COMBUSTION ENGINE

(75) Inventors: Toshihiko Tanaka, Kariya (JP); Akinori Koda, Kariya (JP); Hiroshi Yamashita, Anjo (JP)

(73) Assignee: Denso Corporation, Kariya (JP)

( * ) Notice: Subject to any disclaimer, the term of this patent is extended or adjusted under 35 U.S.C. 154(b) by 324 days.

(21) Appl. No.: 12/354,161

(22) Filed: Jan. 15, 2009

(65) Prior Publication Data

US 2009/0198434 A1 Aug. 6, 2009

(30) Foreign Application Priority Data

Jan. 31, 2008 (JP) ..... 2008-020827
Feb. 7, 2008 (JP) ..... 2008-027991

(51) Int. Cl.
*F02D 41/30* (2006.01)
*F02M 25/07* (2006.01)

(52) U.S. Cl. ..... 701/103

(58) Field of Classification Search ..... 701/103–105, 701/102, 107; 123/673, 674, 698, 568.12
See application file for complete search history.

(56) References Cited

U.S. PATENT DOCUMENTS 4,765,297 A 8/1988 Richter
5,730,111 A 3/1998 Kaji et al.
6,470,682 B2 * 10/2002 Gray, Jr. ..... 123/698

FOREIGN PATENT DOCUMENTS

JP 2006-299945 11/2006
JP 2007-085176 4/2007

* cited by examiner

*Primary Examiner* — Hieu T Vo
(74) *Attorney, Agent, or Firm* — Nixon & Vanderhye PC

(57) ABSTRACT

A cylinder causing an abnormal air-fuel ratio is specified. Injection ratio changing control for gradually changing a ratio between command injection quantities of two injectors of the abnormal cylinder while keeping the sum of the command injection quantities of the two injectors constant is performed on the abnormal cylinder. If the injection ratio changing control is performed under the same condition, a changing behavior of the actual sum injection quantity of the two injectors varies and a changing behavior of the air-fuel ratio varies depending on which one of the two injectors is abnormal. Therefore, the abnormal injector out of the two injectors is specified using a learning value of an air-fuel ratio feedback correction value based on an output of an exhaust gas sensor.

13 Claims, 13 Drawing Sheets

| | Q1 | Q2 | Qsum |
|---|---|---|---|
| R1:R2 = 50:50 | 50 | 50 | 100 |
| R1:R2 = 60:40 | 60 | 40 | 100 |
| R1:R2 = 70:30 | 70 | 30 | 100 |

FIG. 4A

FIG. 4

| |
|---|
| FIG. 4A |
| FIG. 4B |

10% DECREASE IN Q1

| | Q1 | Q2 | Qsum |
|---|---|---|---|
| R1:R2 = 50:50 | 45 | 50 | 95 |
| R1:R2 = 60:40 | 54 | 40 | 94 |
| R1:R2 = 70:30 | 63 | 30 | 93 |

DECREASE

20% DECREASE IN Q1

| | Q1 | Q2 | Qsum |
|---|---|---|---|
| R1:R2 = 50:50 | 40 | 50 | 90 |
| R1:R2 = 60:40 | 48 | 40 | 88 |
| R1:R2 = 70:30 | 56 | 30 | 86 |

DECREASE

30% DECREASE IN Q1

| | Q1 | Q2 | Qsum |
|---|---|---|---|
| R1:R2 = 50:50 | 35 | 50 | 85 |
| R1:R2 = 60:40 | 42 | 40 | 82 |
| R1:R2 = 70:30 | 49 | 30 | 79 |

DECREASE

⇩

LEARNING VALUE CHANGES IN RICHER DIRECTION

FIG. 4B

FIG. 4

| |
|---|
| FIG. 4A |
| FIG. 4B |

10% DECREASE IN Q2

| | Q1 | Q2 | Qsum |
|---|---|---|---|
| R1:R2 = 50:50 | 50 | 45 | 95 |
| R1:R2 = 60:40 | 60 | 36 | 96 |
| R1:R2 = 70:30 | 70 | 27 | 97 |

INCREASE

20% DECREASE IN Q2

| | Q1 | Q2 | Qsum |
|---|---|---|---|
| R1:R2 = 50:50 | 50 | 40 | 90 |
| R1:R2 = 60:40 | 60 | 32 | 92 |
| R1:R2 = 70:30 | 70 | 24 | 94 |

INCREASE

30% DECREASE IN Q2

| | Q1 | Q2 | Qsum |
|---|---|---|---|
| R1:R2 = 50:50 | 50 | 35 | 85 |
| R1:R2 = 60:40 | 60 | 28 | 88 |
| R1:R2 = 70:30 | 70 | 21 | 91 |

INCREASE

⇩

LEARNING VALUE CHANGES IN LEANER DIRECTION

FIG. 5A

FIG. 5

| |
|---|
| FIG. 5A |
| FIG. 5B |

10% INCREASE IN Q1

| | Q1 | Q2 | Qsum |
|---|---|---|---|
| R1:R2 = 50:50 | 55 | 50 | 105 |
| R1:R2 = 60:40 | 66 | 40 | 106 |
| R1:R2 = 70:30 | 77 | 30 | 107 |

INCREASE

20% INCREASE IN Q1

| | Q1 | Q2 | Qsum |
|---|---|---|---|
| R1:R2 = 50:50 | 60 | 50 | 110 |
| R1:R2 = 60:40 | 72 | 40 | 112 |
| R1:R2 = 70:30 | 84 | 30 | 114 |

INCREASE

30% INCREASE IN Q1

| | Q1 | Q2 | Qsum |
|---|---|---|---|
| R1:R2 = 50:50 | 65 | 50 | 115 |
| R1:R2 = 60:40 | 78 | 40 | 118 |
| R1:R2 = 70:30 | 91 | 30 | 121 |

INCREASE

⇩

LEARNING VALUE CHANGES IN LEANER DIRECTION

FIG. 5B

FIG. 5

| |
|---|
| FIG. 5A |
| FIG. 5B |

10% INCREASE IN Q2

| | Q1 | Q2 | Qsum |
|---|---|---|---|
| R1:R2 = 50:50 | 50 | 55 | 105 |
| R1:R2 = 60:40 | 60 | 44 | 104 |
| R1:R2 = 70:30 | 70 | 33 | 103 |

DECREASE

20% INCREASE IN Q2

| | Q1 | Q2 | Qsum |
|---|---|---|---|
| R1:R2 = 50:50 | 50 | 60 | 110 |
| R1:R2 = 60:40 | 60 | 48 | 108 |
| R1:R2 = 70:30 | 70 | 36 | 106 |

DECREASE

30% INCREASE IN Q2

| | Q1 | Q2 | Qsum |
|---|---|---|---|
| R1:R2 = 50:50 | 50 | 65 | 115 |
| R1:R2 = 60:40 | 60 | 52 | 112 |
| R1:R2 = 70:30 | 70 | 39 | 109 |

DECREASE

⇩

LEARNING VALUE CHANGES IN RICHER DIRECTION

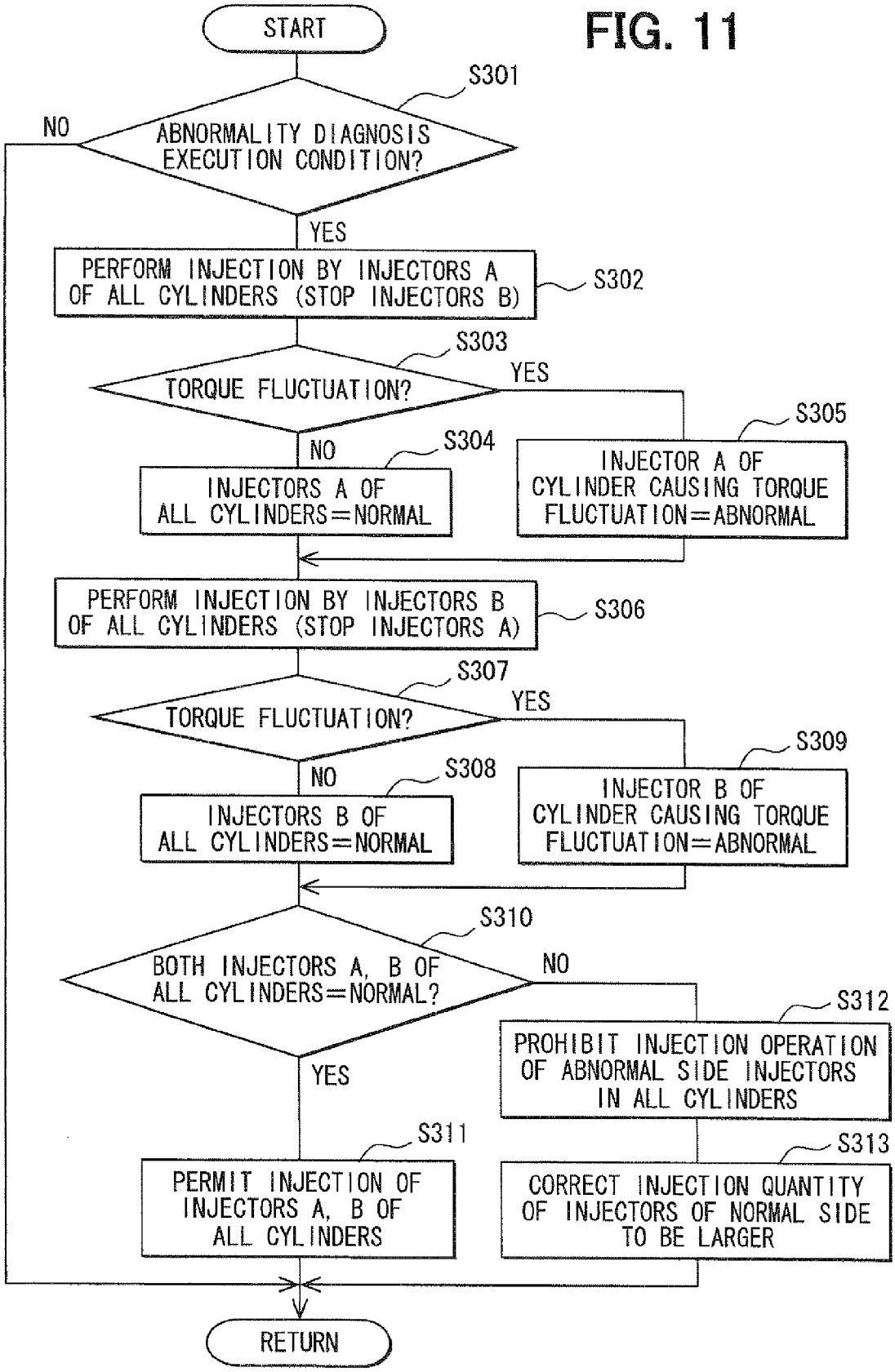
FIG. 11
START
S301
ABNORMALITY DIAGNOSIS EXECUTION CONDITION?
NO
YES
PERFORM INJECTION BY INJECTORS A OF ALL CYLINDERS (STOP INJECTORS B)
S302
S303
TORQUE FLUCTUATION?
YES
NO
S304
INJECTORS A OF ALL CYLINDERS=NORMAL
S305
INJECTOR A OF CYLINDER CAUSING TORQUE FLUCTUATION=ABNORMAL
PERFORM INJECTION BY INJECTORS B OF ALL CYLINDERS (STOP INJECTORS A)
S306
S307
TORQUE FLUCTUATION?
YES
NO
S308
INJECTORS B OF ALL CYLINDERS=NORMAL
S309
INJECTOR B OF CYLINDER CAUSING TORQUE FLUCTUATION=ABNORMAL
S310
BOTH INJECTORS A, B OF ALL CYLINDERS=NORMAL?
NO
YES
S312
PROHIBIT INJECTION OPERATION OF ABNORMAL SIDE INJECTORS IN ALL CYLINDERS
S311
PERMIT INJECTION OF INJECTORS A, B OF ALL CYLINDERS
S313
CORRECT INJECTION QUANTITY OF INJECTORS OF NORMAL SIDE TO BE LARGER
RETURN

ABNORMALITY DIAGNOSIS DEVICE OF INTERNAL COMBUSTION ENGINE

CROSS REFERENCE TO RELATED APPLICATIONS

This application is based on and incorporates herein by reference Japanese Patent Applications No. 2008-20827 filed on Jan. 31, 2008 and No. 2008-27991 filed on Feb. 7, 2008.

BACKGROUND OF THE INVENTION

1. Field of the Invention

The present invention relates to an abnormality diagnosis device of an internal combustion engine provided with multiple injectors for each cylinder of the internal combustion engine.

2. Description of Related Art

As described in Patent document 1 (JP-A-2006-299945), there is a system that is provided with two injectors in two intake ports of each cylinder of an internal combustion engine respectively and that injects fuel into each cylinder through the two injectors, aiming at atomization of a fuel spray and formation of a suitable mixture gas inside the cylinder, for example.

As described in Patent document 2 (JP-A-H8-338285), there is another system that determines an air-fuel ratio of each cylinder based on an output of an air-fuel ratio sensor provided at an exhaust gas merging section, at which exhaust gas of the respective cylinders of the internal combustion engine gathers and flows, and that controls the air-fuel ratio (or fuel injection quantity) for each cylinder.

For example, when the injector of a certain cylinder breaks down and the air-fuel ratio (or the fuel injection quantity) of the cylinder changes, the cylinder causing the abnormal air-fuel ratio can be specified by determining the air-fuel ratio of each cylinder based on the output of the air-fuel ratio sensor with the use of the technology of above-described Patent document 2.

In the system that is provided with the two injectors for each cylinder of the internal combustion engine as in the technology of above-described Patent document 1 for example, when one of the two injectors provided to a certain cylinder breaks down and the air-fuel ratio (or the fuel injection quantity) of the cylinder changes, the cylinder causing the abnormal air-fuel ratio can be specified by using the technology of above-described Patent document 2. However, it cannot be determined which one of the two injectors of the abnormal cylinder is abnormal. Therefore, replacement of both of the two injectors of the abnormal cylinder at a service shop or the like is necessary. Accordingly, the replacement work is time consuming and a cost of replacement parts is high.

As described in Patent document 3 (JP-A-S63-94057), there is another system that is provided with two injectors in two intake ports of each cylinder of the internal combustion engine respectively and that injects fuel through the two injectors for each cylinder, aiming at atomization of a fuel spray or reduction of port wetting (i.e., reduction of adhesion of the fuel to an intake port inner wall) in each cylinder of the internal combustion engine, for example.

As described in Patent document 4 (JP-A-2007-85176), there is yet another system that determines existence or non-existence of abnormality in an air-fuel ratio of each cylinder (i.e., an abnormality of an injector) based on an output of an air-fuel ratio sensor provided at an exhaust gas merging section, at which exhaust gas of the respective cylinders of an internal combustion engine gathers and flows.

In the case where the abnormality diagnosis technology of Patent document 4 is applied to the internal combustion engine of Patent document 3 provided with the two injectors for each cylinder, if either one of the two injectors of a certain cylinder causes an abnormality, the cylinder causing the abnormal air-fuel ratio due to the abnormality in the injector can be specified. However, it is impossible to specify which one of the two injectors of the abnormal cylinder is abnormal. Therefore, replacement of both of the two injectors of the abnormal cylinder at a service shop or the like is necessary. Accordingly, the replacement work is time consuming and a cost of replacement parts is high.

SUMMARY OF THE INVENTION

It is an object of the present invention to provide an abnormality diagnosis device of an internal combustion engine capable of specifying an abnormal injector in a system or an internal combustion engine provided with multiple injectors for each cylinder of the internal combustion engine when an abnormality occurs in certain one of the injectors.

According to an aspect of the present invention, an abnormality diagnosis device of an internal combustion engine provided with a plurality of injectors for each cylinder of the internal combustion engine respectively and with an exhaust gas sensor in an exhaust passage has an abnormality diagnosing section that performs injection ratio changing control for changing a ratio between command injection quantities of the plurality of injectors while keeping the sum of the command injection quantities of the plurality of injectors constant and that performs abnormal injector diagnosis for specifying an abnormal injector out of the plurality of injectors based on an output of the exhaust gas sensor.

When all the multiple injectors provided to one cylinder are normal, even if the injection ratio between the multiple injectors (i.e., the ratio between the command injection quantities) is changed by performing the injection ratio changing control on the cylinder, the actual sum injection quantity (i.e., the sum of the actual injection quantities) of the multiple injectors does not change but remains substantially constant (refer to the sum injection quantity Qsum of FIG. 3 explained in detail later).

In contrast, when an abnormality occurs in certain one of the multiple injectors provided to one cylinder and the injection characteristic of the injector (i.e., relationship between the command injection quantity and the actual injection quantity) changes, if the injection ratio between the multiple injectors is changed by performing the injection ratio changing control on the cylinder, the actual sum injection quantity Qsum of the multiple injectors changes (refer to FIGS. 4A to 5B explained in detail later). Accordingly, the air-fuel ratio of the cylinder, on which the injection ratio changing control is performed, changes and the output of the exhaust gas sensor changes correspondingly. If the injection ratio changing control is performed under the same condition, a changing behavior of the actual sum injection quantity of the multiple injectors varies and therefore a changing behavior of the output of the exhaust gas sensor varies depending on which one of the multiple injectors is abnormal. Therefore, the abnormal injector can be specified out of the injectors by evaluating the output of the exhaust gas sensor or information changing with the output (such as an air-fuel ratio feedback correction value or a learning value of the same) when the injection ratio changing control is performed.

As mentioned above, even if the injection ratio changing control is performed on the cylinder, in which all the multiple injectors are normal, the actual sum injection quantity of the multiple injectors does not change but remains substantially constant, thereby giving substantially no adverse effect to the exhaust emission or the drivability.

If the ratio between the command injection quantities of the multiple injectors is rapidly changed during the injection ratio changing control, there is a possibility that the combustion state changes suddenly and the torque shock occurs, thereby deteriorating the drivability.

Therefore, according to another aspect of the present invention, the abnormality diagnosing section gradually changes the ratio between the command injection quantities of the plurality of injectors in the injection ratio changing control. With such the construction, the torque shock can be suppressed by inhibiting the sudden change in the combustion state due to the injection ratio changing control. As a result, the deterioration of the drivability can be prevented.

The operation conditions such as the fuel injection quantity are changing every moment during a transient operation of the internal combustion engine. Therefore, if the injection ratio changing control is performed during the transient operation, the output change of the exhaust gas sensor due to the injection ratio changing control cannot be sensed with high accuracy because of the influence of the change in the operation conditions. As a result, there is a possibility that the diagnosis accuracy of the abnormal injector diagnosis based on the output of the exhaust gas sensor deteriorates.

Therefore, according to another aspect of the present invention, the abnormality diagnosing section performs the abnormal injector diagnosis by performing the injection ratio changing control during an idle operation of the internal combustion engine. According to another aspect of the present invention, the abnormality diagnosing section performs the abnormal injector diagnosis by performing the injection ratio changing control during a steady operation of the internal combustion engine.

The operation conditions such as the fuel injection quantity are substantially constant during the idle operation or the steady operation. Therefore, if the injection ratio changing control is performed during the idle operation or the steady operation, the output change of the exhaust gas sensor due to the injection ratio changing control can be sensed with high accuracy by substantially eliminating the influence of the change in the operation conditions. As a result, the diagnosis accuracy of the abnormal injector diagnosis based on the output of the exhaust gas sensor can be improved.

Generally, the exhaust gas sensor is arranged at the exhaust gas merging section, at which the exhaust gas of the cylinders gathers and flows. Therefore, specifically in the case of the internal combustion engine having the large number of cylinders, there is a tendency that the output change of the exhaust gas sensor due to the injection ratio changing control reduces because of the influence of the air-fuel ratio of the exhaust gas of the other cylinders even if there occurs a change only in the air-fuel ratio of the exhaust gas of the cylinder, on which the injection ratio changing control is performed. Therefore, it can be difficult to accurately sense the output change of the exhaust gas sensor due to the injection ratio changing control because of the influence of the temporary output change (i.e., variation) of the exhaust gas sensor due to a noise and the like.

Therefore, according to another aspect of the present invention, the abnormality diagnosis device further has an air-fuel ratio feedback control section that performs feedback correction of an air-fuel ratio based on the output of the exhaust gas sensor and the abnormality diagnosing section performs the abnormal injector diagnosis based on a learning value of an air-fuel ratio feedback correction value provided by the air-fuel ratio feedback control section.

Generally, the learning value of the air-fuel ratio feedback correction value is updated in a comparatively long cycle. Therefore, the learning value is less subject to a temporary output change (variation) of the exhaust gas sensor due to a noise and the like. When the injection ratio changing control is performed, the output change of the exhaust gas sensor due to the injection ratio changing control is reflected in the learning value of the air-fuel ratio feedback correction value. Therefore, if the abnormal injector diagnosis is performed based on the learning value of the air-fuel ratio feedback correction value, the diagnosis accuracy of the abnormal injector diagnosis can be further improved by substantially eliminating the influence of the temporary output change of the exhaust gas sensor due to the noise and the like.

According to another aspect of the present invention, the abnormality diagnosis device further has an abnormal cylinder specifying section that specifies a cylinder causing an abnormal air-fuel ratio out of a plurality of cylinders of the internal combustion engine. The abnormality diagnosing section performs the abnormal injector diagnosis by performing the injection ratio changing control on the cylinder that is causing the abnormal air-fuel ratio and that is specified by the abnormal cylinder specifying section. Thus, the abnormal injector can be specified by performing the abnormal injector diagnosis through the execution of the injection ratio changing control only on the cylinder causing the abnormal air-fuel ratio. As a result, the influence of the injection ratio changing control on the drivability can be minimized.

According to another aspect of the present invention, the abnormality diagnosing section performs the injection ratio changing control on respective cylinders of the internal combustion engine in series, thereby performing abnormal cylinder diagnosis for specifying the cylinder causing the abnormal air-fuel ratio out of the plurality of cylinders and the abnormal injector diagnosis based on the output of the exhaust gas sensor.

When certain one of the multiple injectors provided to one cylinder is abnormal and the injection characteristic thereof changes, the air-fuel ratio of the cylinder becomes abnormal. If the injection ratio changing control is performed on the cylinder, the actual sum injection quantity of the multiple injectors changes, and the output of the exhaust gas sensor changes. Therefore, when the injection ratio changing control is performed and the abnormal injector is specified, even if the cylinder causing the abnormal air-fuel ratio is not specified by another construction beforehand, the abnormal injector can be specified while specifying the cylinder causing the abnormal air-fuel ratio by performing the injection ratio changing control on the respective cylinders one by one in series and by evaluating the output of the exhaust gas sensor or the information correlated with the output.

According to another aspect of the present invention, the abnormality diagnosing section performs the abnormal injector diagnosis by performing the injection ratio changing control when a rich-side abnormality or a lean-side abnormality of an air-fuel ratio occurs during an operation of the internal combustion engine.

With such the construction, when neither the rich-side abnormality nor the lean-side abnormality of the air-fuel ratio is caused, it is determined that the injectors of all the cylinders are normal, and the injection ratio changing control and the abnormal injector diagnosis are not performed. Only when the rich-side abnormality or the lean-side abnormality of the air-fuel ratio occurs, it is determined that the abnormality occurs in the injector of certain one of the cylinders, and the abnormal injector is specified by performing the injection ratio changing control and the abnormal injector diagnosis. Therefore, frequent execution of the injection ratio changing control more than necessity pan be avoided.

According to another aspect of the present invention, the abnormality diagnosing section performs the abnormal injector diagnosis by performing the injection ratio changing control during an operation of the internal combustion engine regardless of existence or nonexistence of an abnormality in an air-fuel ratio.

As mentioned above, even if the injection ratio changing control is performed on the cylinder, in which all the multiple injectors are normal, the actual sum injection quantity of the multiple injectors does not change but remains substantially constant. Therefore, if the abnormal injector diagnosis is performed by performing the injection ratio changing control regardless of the existence or nonexistence of the abnormality in the air-fuel ratio during the operation of the internal combustion engine, the abnormality in the injector can be constantly monitored substantially without adversely affecting the exhaust emission or the drivability.

According to another aspect of the present invention, the abnormality diagnosis device further has a failsafe control section that prohibits fuel injection of the abnormal injector and performs increase correction of a fuel injection quantity of the remaining normal injector or injectors when the abnormality diagnosing section specifies the abnormal injector out of the plurality of injectors.

With such the construction, when the abnormality occurs in one of the multiple injectors provided to one cylinder, the fuel of the required injection quantity of the cylinder is injected through the remaining normal injector or injectors, thereby continuing the operation of the internal combustion engine.

According to another aspect of the present invention, an abnormality diagnosis device of an internal combustion engine provided with a plurality of injectors for each cylinder of the internal combustion engine has an abnormality diagnosing section that determines existence or nonexistence of torque fluctuation or fluctuation of a combustion state by causing the plurality of injectors of each cylinder to perform the injection one by one in a switched manner and that specifies an abnormal injector out of the plurality of injectors based on a result of the determination when the abnormality diagnosing section performs abnormality diagnosis of the injector.

If the multiple injectors of each cylinder are caused to perform the injection one by one in a switched manner, the fuel is not injected correctly from the abnormal injector. Therefore, the torque or the combustion state of the internal combustion engine fluctuates when the injection operation of the abnormal injector is performed. Therefore, by causing the multiple injectors of each cylinder to perform the injection one by one in a switched manner and by determining existence or nonexistence of the torque fluctuation or the fluctuation of the combustion state at the time, the injector corresponding to the injection timing immediately preceding the generation timing of the torque fluctuation or the fluctuation of the combustion state can be specified as the abnormal injector.

According to another aspect of the present invention, the abnormality diagnosis device further has a failsafe section that prohibits the injection operation of the injector specified to be abnormal by the abnormality diagnosing section and that performs increase correction of injection quantity of the remaining injector or injectors, thereby injecting fuel quantity equivalent to required injection quantity only through the remaining injector or injectors.

Thus, even when either one of the multiple injectors of one cylinder causes the abnormality, the air-fuel ratio can be controlled to the target air-fuel ratio by injecting the fuel of the quantity equivalent to the required injection quantity only through the remaining injector or injectors. As a result, the operation of the internal combustion engine can be continued while suppressing the deterioration of the drivability or the emission.

According to yet another aspect of the present invention, when the abnormality diagnosing section detects the abnormal injector in certain one of the cylinders, the failsafe section prohibits the injection operation of the injectors in the same positions as the abnormal injector on all the cylinders and performs the increase correction of the injection quantity of remaining injectors, thereby injecting the fuel only through the remaining injectors.

With such the construction, when certain one of the multiple injectors of the cylinder becomes abnormal, the fuel can be injected through the injectors in the same positions in all the cylinders. Accordingly, a fuel spray form (i.e., a forming state of a mixture gas) of the cylinder having the abnormal injector can be prevented from differing from the fuel spay forms of the other cylinders and the fuel spray forms of all the cylinders can be equalized to each other. As a result, the torque fluctuation due to the difference in the fuel spray form among the cylinders of the internal combustion engine can be suppressed.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 4A is a diagram explaining a relationship between the injection ratio and the actual sum injection quantity in the case where a lean-side abnormality occurs in the first injector according to the first embodiment;

FIG. 4B is a diagram explaining a relationship between the injection ratio and the actual sum injection quantity in the case where the lean-side abnormality occurs in the second injector according to the first embodiment;

FIG. 5A is a diagram explaining a relationship between the injection ratio and the actual sum injection quantity in the case where a rich-side abnormality occurs in the first injector according to the first embodiment;

FIG. 5B is a diagram explaining a relationship between the injection ratio and the actual sum injection quantity in the case where the rich-side abnormality occurs in the second injector according to the first embodiment;

FIG. 11 is a flowchart showing a processing flow of an injector abnormality diagnosis routine according to the third embodiment.

DETAILED DESCRIPTION OF EXAMPLE EMBODIMENTS

Figure 1:
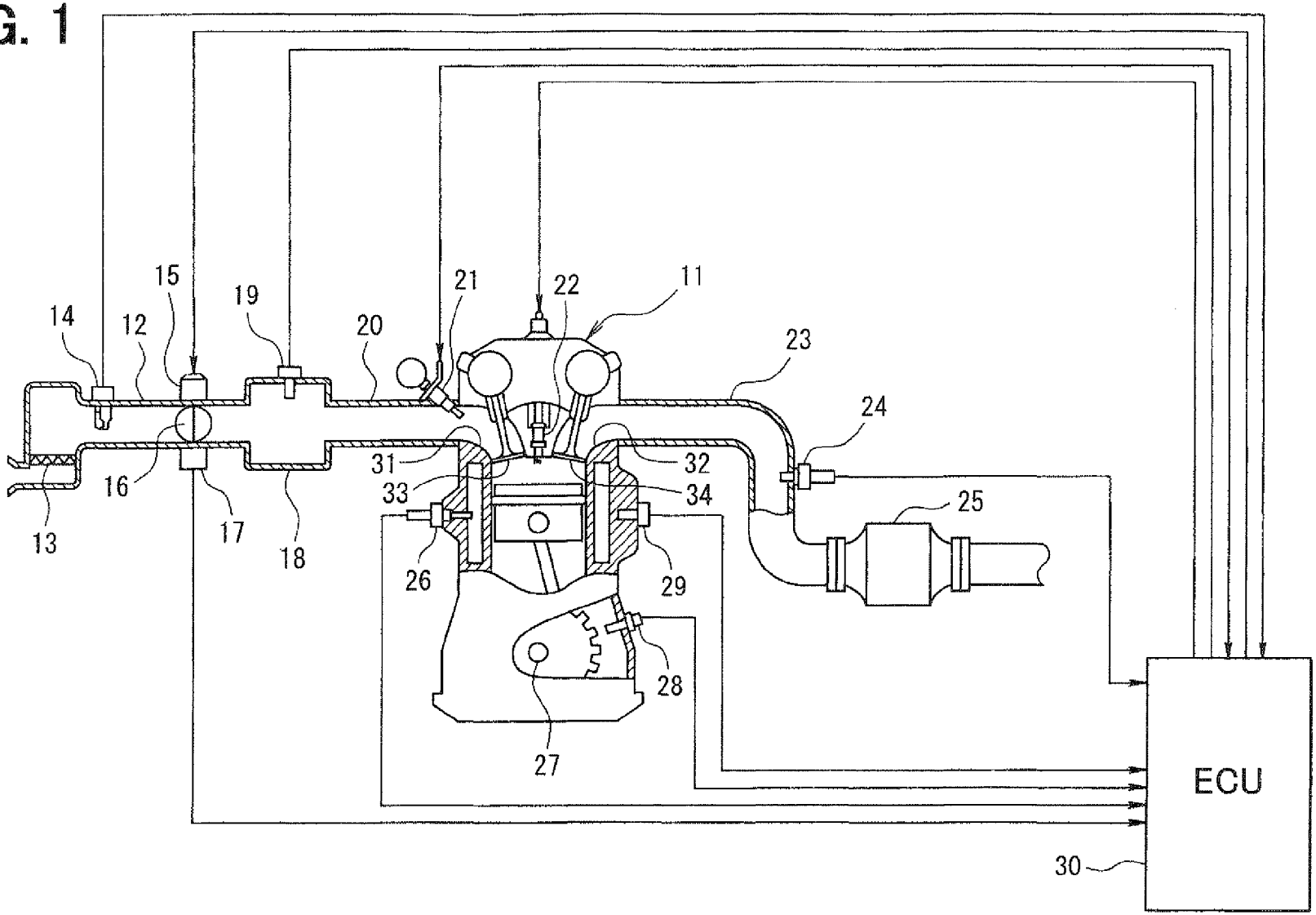
FIG. 1 is a schematic construction diagram showing an engine control system according to a first embodiment of the present invention.

Hereafter, embodiments of the present invention will be described with reference to the drawings.

First, a first embodiment of the present invention will be described with reference to FIGS. 1 to 7. First, a general configuration of an entire engine control system will be explained with reference to FIG. 1.

An air cleaner 13 is provided in the most upstream portion of an intake pipe 12 of an engine 11 (an internal combustion engine). An airflow meter 14 for sensing an air intake quantity is provided downstream of the air cleaner 13. A throttle valve 16, whose opening degree is regulated by a motor 15, and a throttle position sensor 17 for sensing an opening degree (a throttle opening degree) of the throttle valve 16 are provided downstream of the airflow meter 14.

A surge tank 18 is provided downstream of the throttle valve 16, and an intake pipe pressure sensor 19 for sensing intake pipe pressure is provided to the surge tank 18. An intake manifold 20 for introducing the air into each cylinder of the engine 11 is provided to the surge tank 18. An injector 21 for injecting fuel is provided to or near an intake port 31 connected to the intake manifold 20 of each cylinder. Spark plugs 22 are attached to a cylinder head of the engine 11 for the respective cylinders for igniting a fuel air mixture in the cylinders with spark discharge from the respective spark plugs 22.

Figures 2, 3:
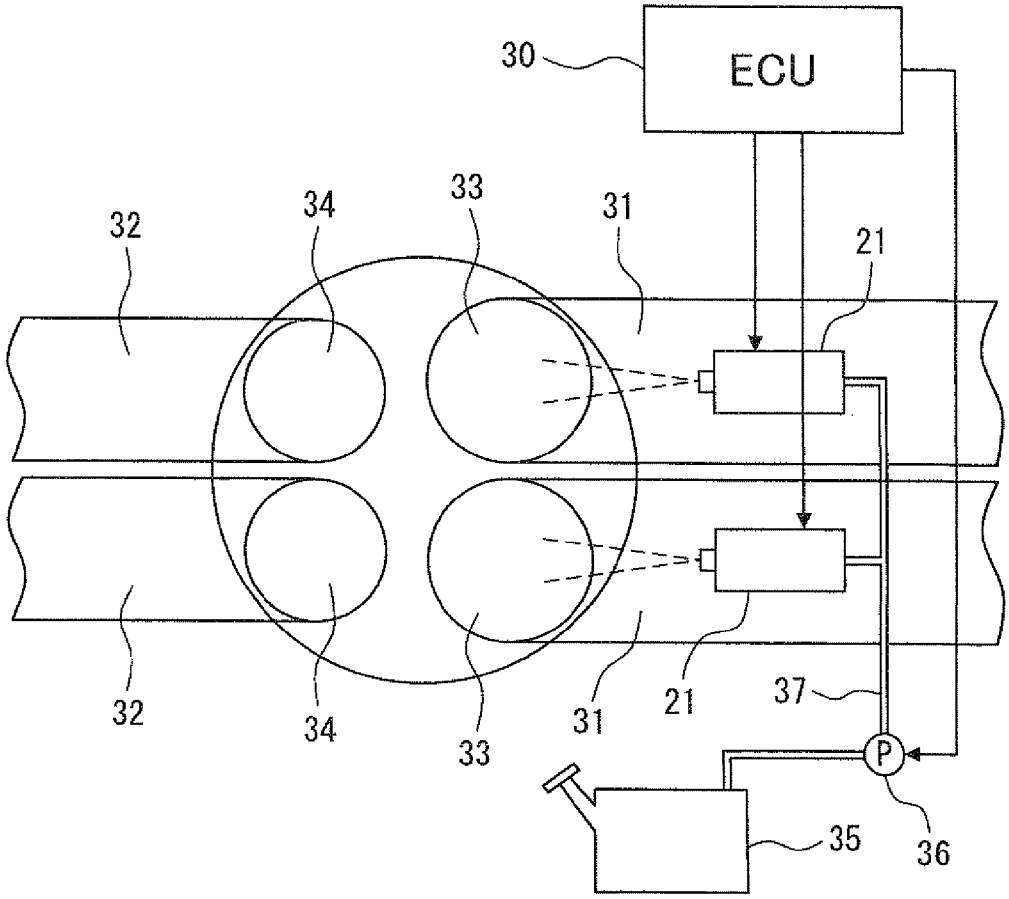
FIG. 2 is a schematic construction diagram showing two injectors provided to one cylinder and a vicinity thereof according to the first embodiment.
FIG. 3 is a diagram explaining a relationship between an injection ratio and actual sum injection quantity in the case where both of first and second injectors are normal according to the first embodiment.

As shown in FIG. 2, the two intake ports 31 and two exhaust ports 32 are provided for each cylinder of the engine 11, respectively. The injector 21 is provided to or near each one of the two intake ports 31 of the cylinder. Each intake port 31 is opened and closed with an intake valve 33. Each exhaust port 32 is opened and closed by an exhaust valve 34. The fuel stored in a fuel tank 35 is drawn by a fuel pump 36. The fuel discharged from the fuel pump 36 is supplied to the injectors 21 of each cylinder through a fuel supply pipe 37.

As shown in FIG. 1, an exhaust gas sensor 24 (an air-fuel ratio sensor, an oxygen sensor, or the like) for sensing an air-fuel ratio or a rich/lean state of exhaust gas or the like is provided in an exhaust pipe 23 (an exhaust passage) of the engine 11. A catalyst 25 such as a three-way catalyst for purifying the exhaust gas is provided downstream of the exhaust gas sensor 24.

A coolant temperature sensor 26 for sensing coolant temperature and a knock sensor 29 for sensing knocking vibration are attached to a cylinder block of the engine 11. A crank angle sensor 28 is provided adjacent to an outer periphery of a crankshaft 27. The crank angle sensor 28 outputs a pulse signal every time the crankshaft 27 rotates by a predetermined crank angle. A crank angle and engine rotation speed are sensed based on an output signal of the crank angle sensor 28.

Outputs of the above various sensors are inputted to an engine control circuit 30 (referred to as an ECU, hereinafter). The ECU 30 is constituted mainly by a microcomputer. The ECU 30 executes various kinds of engine control programs stored in an incorporated ROM (a storage medium) to control fuel injection quantity of the injector 21 and ignition timing of the spark plug 22 according to an engine operation condition. Normally, the two injectors 21 provided to each cylinder are controlled to equalize the fuel injection quantities of the two injectors 21 to each other (i.e., such that a ratio between the fuel injection quantities is 50:50).

When a predetermined air-fuel ratio feedback control execution condition is satisfied, the ECU 30 calculates an air-fuel ratio feedback correction value to conform the air-fuel ratio of the exhaust gas to a target air-fuel ratio (for example, a theoretical air-fuel ratio) based on the output of the exhaust gas sensor 24. The ECU 30 performs the air-fuel ratio feedback control for correcting the fuel injection quantity of the injector 21 by using the air-fuel ratio feedback correction value. This function plays a role of an air-fuel ratio feedback control section.

The ECU 30 learns the air-fuel ratio feedback correction value in a predetermined cycle longer than a calculation cycle of the air-fuel ratio feedback correction value during the air-fuel ratio feedback control. The ECU 30 stores the learning value of the learned air-fuel ratio feedback correction value in a rewritable nonvolatile memory (a rewritable memory that holds the stored data even while the power supply to the ECU 30 is off) such as a backup RAM (not shown) of the ECU 30.

The ECU 30 executes an injector abnormality diagnosis routine of FIGS. 6 and 7 (explained later) to perform abnormality diagnosis of the injector 21 as follows. When a rich-side abnormality, in which the air-fuel ratio of the exhaust gas fluctuates to a richer side than the target air-fuel ratio, or a lean-side abnormality, in which the air-fuel ratio fluctuates to a leaner side than the target air-fuel ratio, occurs during engine operation, the cylinder causing the abnormal air-fuel ratio is specified from among the multiple cylinders of the engine 11. Then, injection ratio changing control is performed on the cylinder causing the abnormal air-fuel ratio to gradually change a ratio between command injection quantities of the two injectors 21 of the cylinder while keeping the sum of the command injection quantities of the two injectors 21 constant. Thus, abnormal injector diagnosis for specifying the abnormal injector 21 out of the two injectors 21 is performed using the learning value of the air-fuel ratio feedback correction value based on the output of the exhaust gas sensor 24.

Hereafter, a method of specifying the abnormal injector 21 will be explained. Hereafter, one of the two injectors 21 provided to one cylinder is referred to also as a first injector 21A, and the other one of the two injectors 21 is referred to also as a second injector 21B.

As shown in FIG. 3, when both of the first injector 21A and the second injector 21B provided to a certain cylinder are normal, even if the injection ratio changing control is performed on the cylinder and the injection ratio between the first and second injectors 21A, 21B (i.e., the ratio between the command injection quantity R1 of the first injector 21A and the command injection quantity R2 of the second injector 21B) is changed from the normal ratio (for example, R1:R2=50:50) to a predetermined ratio (for example, R1:R2=70:30) while keeping the sum of the command injection quantities of the first and second injectors 21A, 21B constant, the actual sum injection quantity Qsum of the first and second injectors 21A, 21B (i.e., the sum of the actual injection quantity Q1 of the first injector 21A and the actual injection quantity Q2 of the second injector 21B) does not change but remains substantially constant.

In contrast, as shown in FIG. 4A, when the lean-side abnormality occurs in the first injector 21A out of the first and second injectors 21A, 21B provided to a certain cylinder and the injection characteristic of the first injector 21A changes in a leaner direction (i.e., a direction in which the actual injection quantity becomes smaller than the command injection quantity), if the injection ratio changing control is performed on the same cylinder and the injection ratio (i.e., the ratio between the command injection quantities R1, R2) between the first and second injectors 21A, 21B is changed from the normal ratio (for example, R1:R2=50:50) to a predetermined ratio (for example, R1:R2=70:30) while keeping the sum of the command injection quantities of the first and second injectors 21A, 21B constant, the actual sum injection quantity Qsum of the first and second injectors 21A, 21B decreases correspondingly. Accordingly, the air-fuel ratio of the cylinder, on which the injection ratio changing control is performed, changes in the leaner direction. Correspondingly, the output of the exhaust gas sensor 24 changes in the leaner direction and the learning value of the air-fuel ratio feedback correction value changes in a richer direction (i.e., a direction for correcting the air-fuel ratio to be richer). FIG. 4A shows three cases of the injection ratio changing control performed when the lean-side abnormality occurs in the first injector 21A. The upper table in FIG. 4A shows the case where the actual injection quantity Q1 of the first injector 21A has decreased by 10%. The middle table in FIG. 4A shows the case where the actual injection quantity Q1 of the first injector 21A has decreased by 20%. The lower table in FIG. 4A shows the case where the actual injection quantity Q1 of the first injector 21A has decreased by 30%.

As shown in FIG. 4B, when the lean-side abnormality occurs in the second injector 21B out of the first and second injectors 21A, 21B provided to a certain cylinder and the injection characteristic of the second injector 21B changes in the leaner direction, if the injection ratio changing control is performed on the same cylinder, the actual sum injection quantity Qsum of the first and second injectors 21A, 21B increases correspondingly. Accordingly, the air-fuel ratio of the cylinder, on which the injection ratio changing control is performed, changes in the richer direction. Correspondingly, the output of the exhaust gas sensor 24 changes in the richer direction and the learning value of the air-fuel ratio feedback correction value changes in the leaner direction (i.e., a direction for correcting the air-fuel ratio to be leaner). FIG. 4B shows three cases of the injection ratio changing control performed when the lean-side abnormality occurs in the second injector 21B. The upper table in FIG. 4B shows the case where the actual injection quantity Q2 of the second injector 21B has decreased by 10%. The middle table in FIG. 4B shows the case where the actual injection quantity Q2 of the second injector 21B has decreased by 20%. The lower table in FIG. 4B shows the case where the actual injection quantity Q2 of the second injector 21B has decreased by 30%.

Therefore, when the lean-side abnormality of the air-fuel ratio occurs, the lean-side abnormality cylinder causing the lean-side abnormality is specified. In this case, if the learning value of the air-fuel ratio feedback correction value changes in the richer direction when the injection ratio changing control is performed on the lean-side abnormality cylinder, it can be determined that the first injector 21A of the lean-side abnormality cylinder is causing the lean-side abnormality. If the learning value of the air-fuel ratio feedback correction value changes in the leaner direction, it can be determined that the second injector 21B of the lean-side abnormality cylinder is causing the lean-side abnormality.

As shown in FIG. 5A, when the rich-side abnormality occurs in the first injector 21A out of the first and second injectors 21A, 21B provided to a certain cylinder and the injection characteristic of the first injector 21A changes in the richer direction (i.e., a direction in which the actual injection quantity becomes larger than the command injection quantity), if the injection ratio changing control is performed on the same cylinder, the actual sum injection quantity Qsum of the first and second injectors 21A, 218 increases correspondingly. Accordingly, the air-fuel ratio of the cylinder, on which the injection ratio changing control is performed, changes in the richer direction. Correspondingly, the output of the exhaust gas sensor 24 changes in the richer direction and the learning value of the air-fuel ratio feedback correction value changes in the leaner direction. FIG. 5A shows three cases of the injection ratio changing control performed when the rich-side abnormality occurs in the first injector 21A. The upper table in FIG. 5A shows the case where the actual injection quantity Q1 of the first injector 21A has increased by 10%. The middle table in FIG. 5A shows the case where the actual injection quantity Q1 of the first injector 21A has increased by 20%. The lower table in FIG. 5A shows the case where the actual injection quantity Q1 of the first injector 21A has increased by 30%.

As shown in FIG. 5B, when the rich-side abnormality occurs in the second injector 21B out of the first and second injectors 21A, 21B provided to a certain cylinder and the injection characteristic of the second injector 21B changes in the richer direction, if the injection ratio changing control is performed on the same cylinder, the actual sum injection quantity Qsum of the first and second injectors 21A, 21B decreases correspondingly. Accordingly, the air-fuel ratio of the cylinder, on which the injection ratio changing control is performed, changes in the leaner direction. Correspondingly, the output of the exhaust gas sensor 24 changes in the leaner direction and the learning value of the air-fuel ratio feedback correction value changes in the richer direction. FIG. 5B shows three cases of the injection ratio changing control performed when the rich-side abnormality occurs in the second injector 21B. The upper table in FIG. 5B shows the case where the actual injection quantity Q2 of the second injector 21B has increased by 10%. The middle table in FIG. 5B shows the case where the actual injection quantity Q2 of the second injector 21B has increased by 20%. The lower table in FIG. 5B shows the case where the actual injection quantity Q2 of the second injector 21B has increased by 30%.

Therefore, when the rich-side abnormality of the air-fuel ratio occurs, the rich-side abnormality cylinder causing the rich-side abnormality is specified. If the learning value of the air-fuel ratio feedback correction value changes in the leaner direction when the injection ratio changing control is performed on the rich-side abnormality cylinder, it can be determined that the first injector 21A of the rich-side abnormality cylinder is causing the rich-side abnormality. If the learning value of the air-fuel ratio feedback correction value changes in the richer direction, it can be determined that the second injector 21B of the rich-side abnormality cylinder is causing the rich-side abnormality.

Figure 6:
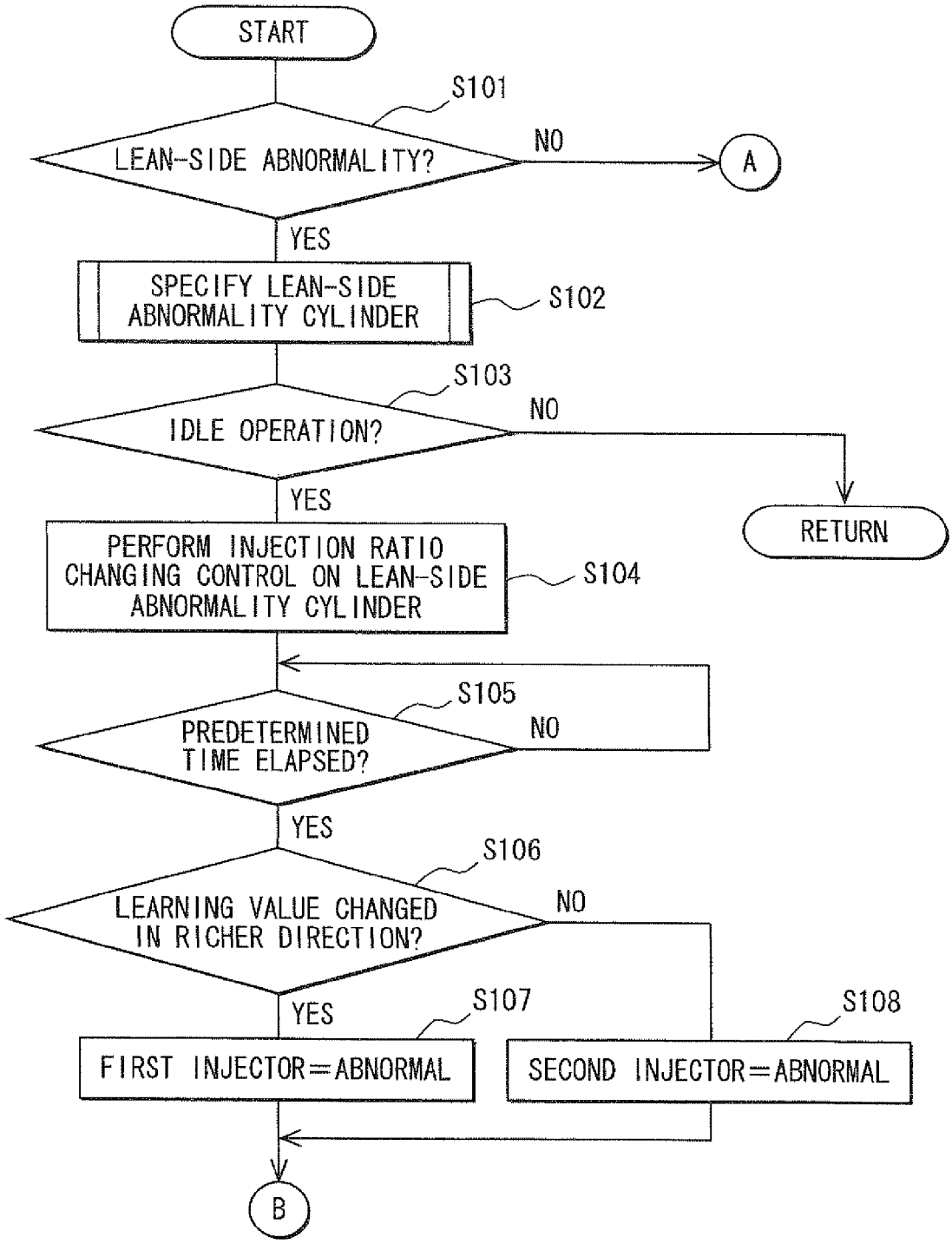
FIG. 6 is a part of a flowchart showing a processing flow of an injector abnormality diagnosis routine according to the first embodiment.
Figure 7:
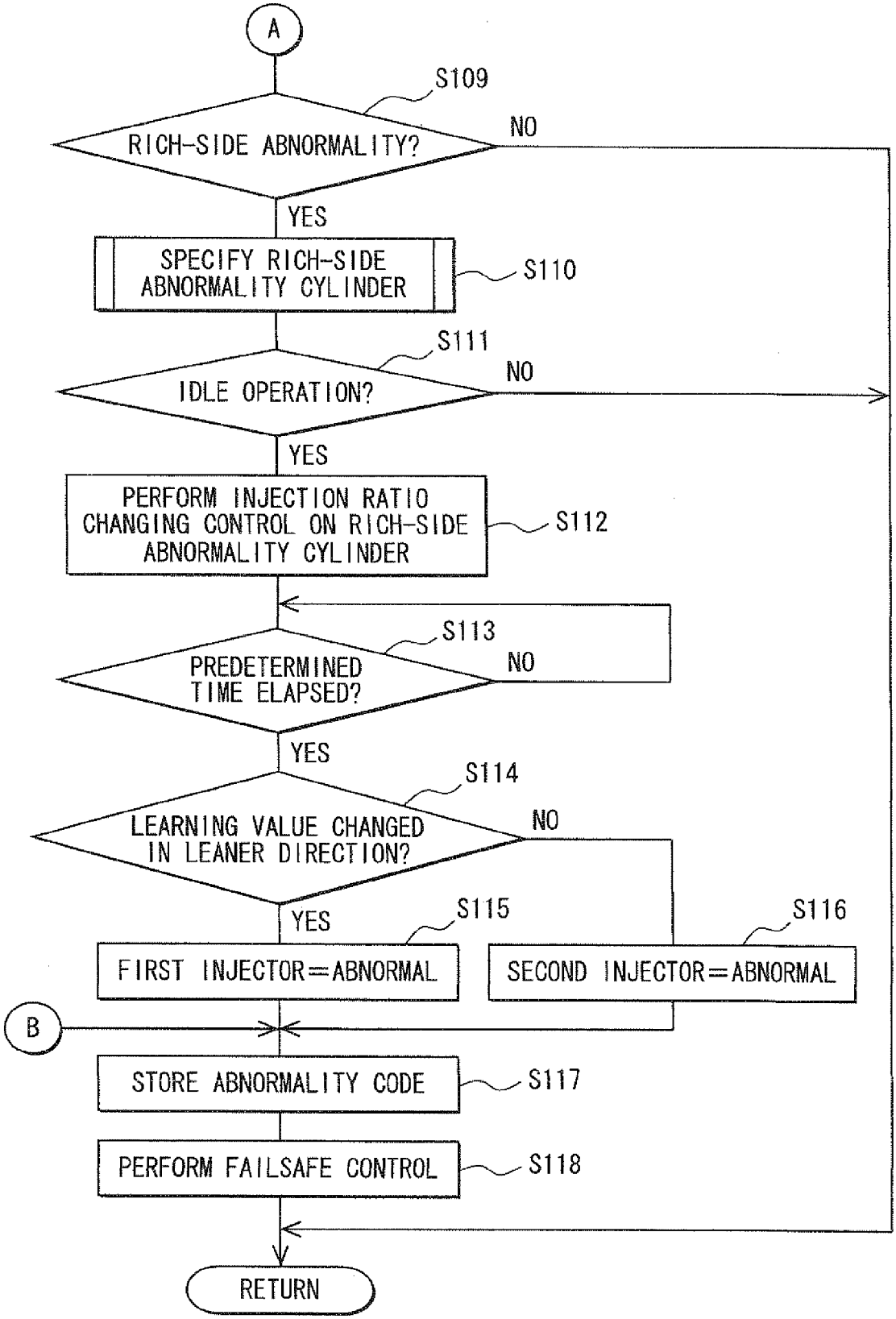
FIG. 7 is the other part of the flowchart showing the processing flow of the injector abnormality diagnosis routine according to the first embodiment.

The above-described abnormality diagnosis of the injector 21 is performed by the ECU 30 according to a routine shown in FIGS. 6 and 7. Hereafter, processing contents of the routine will be explained.

The injector abnormality diagnosis routine shown in FIGS. 6 and 7 is executed in a predetermined cycle while power supply to the ECU 30 is on and functions as an abnormality diagnosing section. If the routine is started, first in S101 (S means "Step"), it is determined whether the lean-side abnormality, in which the air-fuel ratio of the exhaust gas fluctuates to the leaner side than the target air-fuel ratio, has occurred based on the output of the exhaust gas sensor 24. When it is determined that the lean-side abnormality of the air-fuel ratio has occurred, it is determined that the lean-side abnormality has occurred in the injector 21 of certain one of the cylinders. Then, the abnormal injector 21 is specified by performing the injection ratio changing control and the abnormal injector diagnosis as follows.

First, in S102, a lean-side abnormality cylinder specifying routine (not shown) is performed. Thus, the air-fuel ratio of each cylinder is determined based on the output of the exhaust gas sensor 24, and the lean-side abnormality cylinder causing the lean-side abnormality of the air-fuel ratio is specified. The processing of S102 functions as an abnormal cylinder specifying section.

Then, the process proceeds to S103, where it is determined whether the idle operation is in execution. If it is determined that the idle operation is in execution, the process proceeds to S104, where the injection ratio changing control is performed on the lean-side abnormality cylinder. Thus, the injection ratio between the first and second injectors 21A, 21B is gradually changed from the normal ratio (for example, R1:R2=50:50) to a predetermined ratio (for example, R1:R2=70:30) while keeping the sum of the command injection quantities of the first and second injectors 21A, 21B constant. In the control, the injection ratio between the first and second injectors 21A, 21B may be changed continuously or stepwise from the normal ratio to the predetermined ratio.

Then, the process proceeds to S105, where it is determined whether a predetermined time has elapsed. In S105, it is determined whether the predetermined time has elapsed by determining whether a predetermined time necessary from the start of the injection ratio changing control to the end of the change in the learning value of the air-fuel ratio feedback correction value due to the injection ratio changing control has elapsed. Alternatively, it may be determined whether the predetermined time has elapsed by determining whether the change in the learning value of the air-fuel ratio feedback correction value due to the injection ratio changing control has ended.

If it is determined in S105 that the predetermined time has elapsed, the process proceeds to S106, where it is determined whether the learning value of the air-fuel ratio feedback correction value has changed in the richer direction. If it is determined that the learning value of the air-fuel ratio feedback correction value has changed in the richer direction, the process proceeds to S107, where it is determined that the first injector 21A of the lean-side abnormality cylinder is causing the lean-side abnormality. If it is determined in S106 that the learning value of the air-fuel ratio feedback correction value has changed in the leaner direction, the process proceeds to S108, where it is determined that the second injector 21B of the lean-side abnormality cylinder is causing the lean-side abnormality.

When it is determined in S101 that the lean-side abnormality of the air-fuel ratio has not occurred, the process proceeds to S109 of FIG. 7. In S109, it is determined whether the rich-side abnormality, in which the air-fuel ratio of the exhaust gas fluctuates to the richer side than the target air-fuel ratio, has occurred based on the output of the exhaust gas sensor 24. When it is determined that the rich-side abnormality of the air-fuel ratio has occurred, it is determined that the rich-side abnormality has occurred in the injector 21 of certain one of the cylinders. Then, the abnormal injector 21 is specified by performing the injection ratio changing control and the abnormal injector diagnosis as follows.

First, in S110, a rich-side abnormality cylinder specifying routine (not shown) is performed. Thus, the air-fuel ratio of each cylinder is determined based on the output of the exhaust gas sensor 24, and the rich-side abnormality cylinder causing the rich-side abnormality of the air-fuel ratio is specified. The processing of S110 functions as an abnormal cylinder specifying section.

Then, the process proceeds to S111, where it is determined whether the idle operation is in execution. If it is determined that the idle operation is in execution, the process proceeds to S112, where the injection ratio changing control is performed on the rich-side abnormality cylinder. Then, in following S113, it is determined whether a predetermined time has elapsed.

If it is determined in S113 that the predetermined time has elapsed, the process proceeds to S114, where it is determined whether the learning value of the air-fuel ratio feedback correction value has changed in the leaner direction. If it is determined that the learning value of the air-fuel ratio feedback correction value has changed in the leaner direction, the process proceeds to S115, where it is determined that the first injector 21A of the rich-side abnormality cylinder is causing the rich-side abnormality. If it is determined in S114 that the learning value of the air-fuel ratio feedback correction value has changed in the richer direction, the process proceeds to S116, where it is determined that the second injector 21B of the rich-side abnormality cylinder is causing the rich-side abnormality.

After specifying the abnormal cylinder and the abnormal injector 21 as mentioned above, the process proceeds to S117. In S117, abnormality information (i.e., an abnormality code) is stored in a rewritable nonvolatile memory such as a backup RAM (not shown) of the ECU 30. Then, the process proceeds to S118, where failsafe control is performed. In the failsafe control, the fuel injection of the abnormal injector 21 of the abnormal cylinder is prohibited and increase correction of the fuel injection quantity of the remaining normal injector 21 is performed, thereby injecting the fuel of the requested injection quantity of the abnormal cylinder through the normal injector 21. The processing of S118 functions as a failsafe control section.

When it is determined in S101 that the lean-side abnormality of the air-fuel ratio is not caused and it is determined in S109 that the rich-side abnormality of the air-fuel ratio is not caused, it is determined that the injectors 21 of all the cylinders are normal, and the routine is ended without performing the injection ratio changing control and the abnormal injector diagnosis.

In the above-explained first embodiment, when the lean-side abnormality or the rich-side abnormality of the air-fuel ratio occurs during the engine operation, the lean-side abnormality cylinder causing the lean-side abnormality or the rich-side abnormality cylinder causing the rich-side abnormality is specified. Then, the injection ratio changing control is performed on the lean-side abnormality cylinder or the rich-side abnormality cylinder to gradually change the ratio between the command injection quantities of the two injectors 21 of the cylinder while keeping the sum of the command injection quantities of the two injectors 21 constant. Thus, the abnormal injector diagnosis for specifying the abnormal injector 21 out of the two injectors 21 is performed using the learning value of the air-fuel ratio feedback correction value based on the output of the exhaust gas sensor 24. Accordingly, when the abnormality occurs in the injector 21 in the system having the two injectors 21 per cylinder, the abnormal injector 21 can be specified.

Moreover, in the first embodiment, the ratio between the command injection quantities of the two injectors 21 is gradually changed during the injection ratio changing control. Accordingly, sudden change in the combustion state due to the injection ratio changing control can be inhibited and occurrence of torque shock can be inhibited, thereby suppressing deterioration of drivability.

Moreover, in the first embodiment, the injection ratio changing control is performed and the abnormal injector diagnosis is performed during the idle operation, in which the operation conditions such as the fuel injection quantity are substantially constant. Therefore, the output change of the exhaust gas sensor 24 due to the injection ratio changing control can be sensed accurately without being affected by the change in the operation condition. As a result, the diagnosis accuracy of the abnormal injector diagnosis based on the output of the exhaust gas sensor 24 can be improved.

Generally, the learning value of the air-fuel ratio feedback correction value is updated in a comparatively long cycle. Therefore, the learning value is less subject to a temporary output change (variation) of the exhaust gas sensor 24 caused by a noise and the like. When the injection ratio changing control is performed, the output change of the exhaust gas sensor 24 due to the injection ratio changing control is reflected in the learning value of the air-fuel ratio feedback correction value. Paying attention to this point, the abnormal injector diagnosis is performed based on the learning value of the air-fuel ratio feedback correction value in the first embodiment. Therefore, the diagnosis accuracy of the abnormal injector diagnosis can be improved further by substantially eliminating the influence of the temporary output change of the exhaust gas sensor 24 due to the noise and the like.

Moreover, in the first embodiment, when neither the rich-side abnormality nor the lean-side abnormality of the air-fuel ratio is caused, it is determined that the injectors 21 of all the cylinders are normal, and the injection ratio changing control and the abnormal injector diagnosis are not performed. Only when the rich-side abnormality or the lean-side abnormality of the air-fuel ratio occurs, it is determined that the abnormality occurs in the injector 21 of certain one of the cylinders, and the abnormal injector 21 is specified by performing the injection ratio changing control and the abnormal injector diagnosis. Therefore, frequent execution of the injection ratio changing control more than necessity can be avoided.

Furthermore, in the first embodiment, when the lean-side abnormality or the rich-side abnormality of the air-fuel ratio occurs, the air-fuel ratio of each cylinder is determined based on the output of the exhaust gas sensor 24, and the lean-side abnormality cylinder or the rich-side abnormality cylinder is specified. Then, the abnormal injector diagnosis is performed by performing the injection ratio changing control on the lean-side abnormality cylinder or the rich-side abnormality cylinder. Accordingly, the abnormal injector 21 can be specified by performing the abnormal injector diagnosis through the execution of the injection ratio changing control only on the lean-side abnormality cylinder or the rich-side abnormality cylinder.

Moreover, in the first embodiment, when the abnormal injector 21 of the abnormal cylinder is specified, the fuel injection of the abnormal injector 21 is prohibited and the increasing correction of the fuel injection quantity of the remaining normal injector 21 is performed, thereby injecting the fuel of the required injection quantity of the abnormal cylinder through the normal injector 21. Therefore, even if the abnormality occurs in one of the two injectors 21 of a certain cylinder, the fuel of the required injection quantity can be injected through the remaining normal injector 21, and the operation of the engine 11 can be continued.

Next, a second embodiment of the present invention will be described with reference to FIGS. 8 and 9. In the following description, differences from the first embodiment will be mainly explained.

In the second embodiment, an injector abnormality diagnosis routine of FIGS. 8 and 9 explained in detail later is performed. Thus, when the lean-side abnormality or the rich-side abnormality of the air-fuel ratio occurs, the injection ratio changing control is performed on respective cylinders in series one by one. Thus, abnormal cylinder diagnosis for specifying the lean-side abnormality cylinder or the rich-side abnormality cylinder and abnormal injector diagnosis for specifying the abnormal injector 21 are performed.

Figure 8:
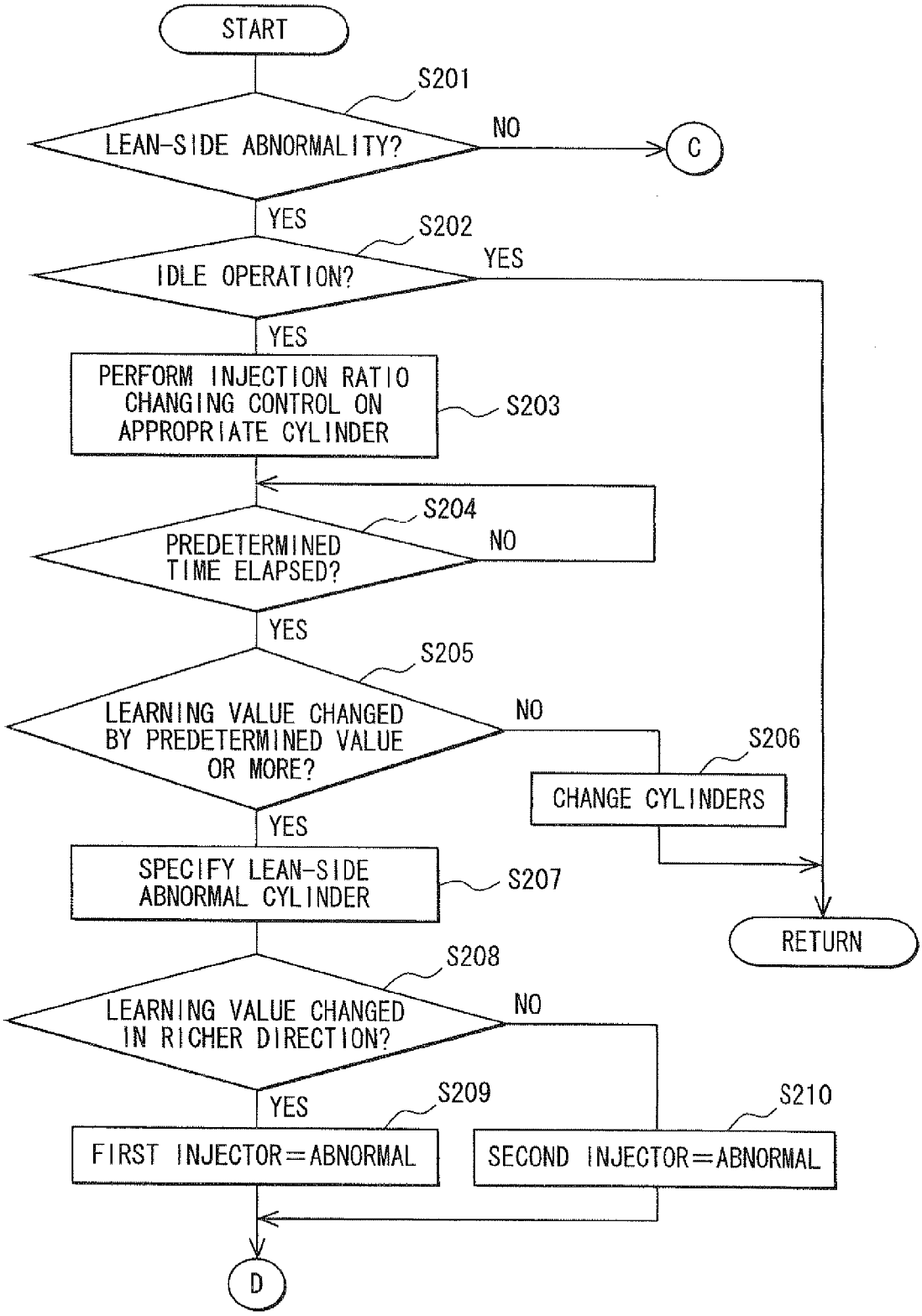
FIG. 8 is a part of a flowchart showing a processing flow of an injector abnormality diagnosis routine according to a second embodiment of the present invention.
Figure 9:
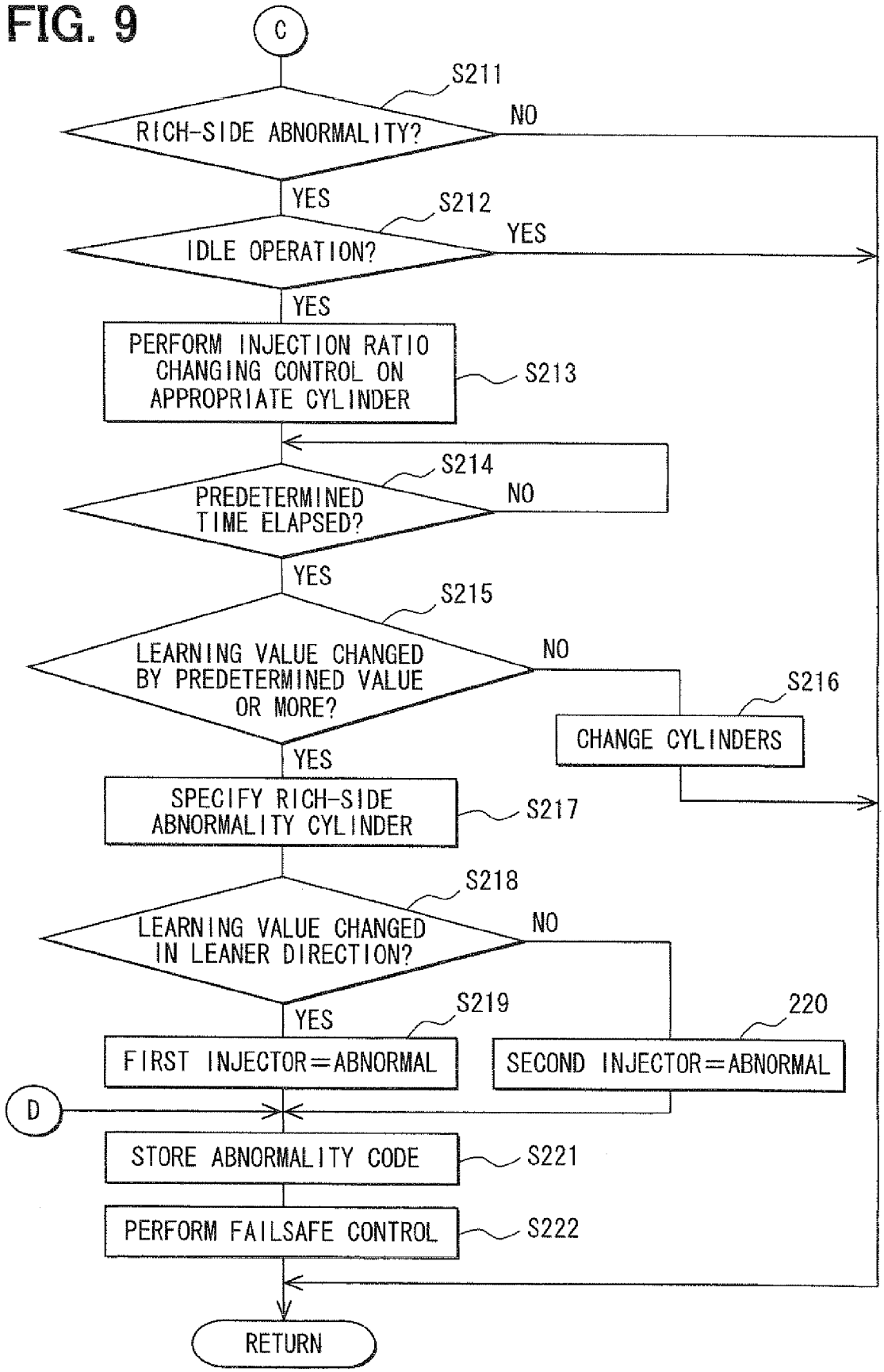
FIG. 9 is the other part of the flowchart showing the processing flow of the injector abnormality diagnosis routine according to the second embodiment.

In the injector abnormality diagnosis routine shown in FIGS. 8 and 9, it is determined first in S201 whether the lean-side abnormality of the air-fuel ratio has occurred. When it is determined that the lean-side abnormality of the air-fuel ratio has occurred, it is determined that the lean-side abnormality has occurred in the injector 21 of certain one of the cylinders. Then, the injection ratio changing control is performed on the respective cylinders in series one by one as follows. Thus, the abnormal cylinder diagnosis for specifying the lean-side abnormality cylinder and the abnormal injector diagnosis for specifying the abnormal injector 21 are performed.

First, in S202, it is determined whether the idle operation is in execution. If it is determined that the idle operation is in execution, the process proceeds to S203, where the injection ratio changing control is performed on an appropriate cylinder of this time. Then, the process proceeds to S204, where it is determined whether a predetermined time has elapsed.

When it is determined in S204 that the predetermined time has elapsed, the process proceeds to S205, where it is determined whether a change amount of the learning value of the air-fuel ratio feedback correction value in the leaner direction or the richer direction is equal to or greater than a predetermined value. If it is determined that the change amount of the learning value of the air-fuel ratio feedback correction value is smaller than the predetermined value, it is determined both of the two injectors 21 of the cylinder, on which the injection ratio changing control is performed this time, are normal, and the process proceeds to S206. In S206, the cylinder, on which the injection ratio changing control is performed, is changed. Thus, the injection ratio changing control is performed on the respective cylinders in series one by one.

Thereafter, when it is determined in S205 that the change amount of the learning value of the air-fuel ratio feedback correction value is equal to or greater than the predetermined value, the process proceeds to S207, where it is determined that the cylinder, on which the injection ratio changing control is performed this time, is the lean-side abnormality cylinder.

Then, the process proceeds to S208, where it is determined whether the learning value of the air-fuel ratio feedback correction value has changed in the richer direction. If it is determined that the learning value of the air-fuel ratio feedback correction value has changed in the richer direction, the process proceeds to S209, where it is determined that the first injector 21A of the lean-side abnormality cylinder is causing the lean-side abnormality. If it is determined in S208 that the learning value of the air-fuel ratio feedback correction value has changed in the leaner direction, the process proceeds to S210, where it is determined that the second injector 21B of the lean-side abnormality cylinder is causing the lean-side abnormality.

When it is determined in S201 that the lean-side abnormality of the air-fuel ratio is not caused, the process proceeds to S211 of FIG. 9. In S211, it is determined whether the rich-side abnormality of the air-fuel ratio has occurred. When it is determined that the rich-side abnormality of the air-fuel ratio has occurred, it is determined that the rich-side abnormality has occurred in the injector 21 of certain one of the cylinders. Then, the injection ratio changing control is performed on the respective cylinders in series one by one as follows. Thus, the abnormal cylinder diagnosis for specifying the rich-side abnormality cylinder and the abnormal injector diagnosis for specifying the abnormal injector 21 are performed.

First, in S212, it is determined whether the idle operation is in execution. If it is determined that the idle operation is in execution, the process proceeds to S213. In S213, the injection ratio changing control is performed on the appropriate cylinder of this time. Then, the process proceeds to S214, where it is determined whether a predetermined time has elapsed.

When it is determined in S214 that the predetermined time has elapsed, the process proceeds to S215, where it is determined whether a change amount of the learning value of the air-fuel ratio feedback correction value in the leaner direction or the richer direction is equal to or greater than a predetermined value. If it is determined that the change amount of the learning value of the air-fuel ratio feedback correction value is smaller than the predetermined value, it is determined that both of the two injectors 21 of the cylinder, on which the injection ratio changing control is performed this time, are normal, and the process proceeds to S216. In S216, the cylinder on which the injection ratio changing control is performed, is changed. Thus, the injection ratio changing control is performed on the respective cylinders in series one by one.

Thereafter, when it is determined in S215 that the change amount of the learning value of the air-fuel ratio feedback correction value is equal to or greater than the predetermined value, the process proceeds to S217, where it is determined that the cylinder, on which the injection ratio changing control is performed this time, is the rich-side abnormality cylinder.

Then, the process proceeds to S218, where it is determined whether the learning value of the air-fuel ratio feedback correction value has changed in the leaner direction. If it is determined that the learning value of the air-fuel ratio feedback correction value has changed in the leaner direction, the process proceeds to S219, where it is determined that the first injector 21A of the rich-side abnormality cylinder is causing the rich-side abnormality. If it is determined in S218 that the learning value of the air-fuel ratio feedback correction value has changed in the richer direction, the process proceeds to S220, where it is determined that the second injector 21B of the rich-side abnormality cylinder is causing the rich-side abnormality.

After specifying the abnormal cylinder and the abnormal injector 21 as mentioned above, the process proceeds to S221. In S221, abnormality information (i.e., an abnormality code) is stored in a rewritable nonvolatile memory such as a backup RAM (not shown) of the ECU 30. Then, the process proceeds to S222, where failsafe control is performed. In the failsafe control, the fuel injection of the abnormal injector 21 of the abnormal cylinder is prohibited and increase correction of the fuel injection quantity of the remaining normal injector 21 of the abnormal cylinder is performed, thereby injecting the fuel of the requested injection quantity of the abnormal cylinder through the normal injector 21.

When it is determined in S201 that the lean-side abnormality of the air-fuel ratio is not caused and it is determined in S211 that the rich-side abnormality of the air-fuel ratio is not caused, it is determined that the injectors 21 of all the cylinders are normal, and the routine is ended without performing the injection ratio changing control, the abnormal cylinder diagnosis and the abnormal injector diagnosis.

In the above-described second embodiment, when the lean-side abnormality or the rich-side abnormality of the air-fuel ratio occurs, the injection ratio changing control is performed on the respective cylinders in series one by one. Thus, the abnormal cylinder diagnosis for specifying the lean-side abnormal cylinder or the rich-side abnormal cylinder and the abnormal injector diagnosis for specifying the abnormal injector 21 are performed. Accordingly, even without specifying the lean-side abnormality cylinder or the rich-side abnormality cylinder beforehand by another construction, the abnormal injector 21 can be specified while specifying the lean-side abnormality cylinder or the rich-side abnormality cylinder by performing the injection ratio changing control on the respective cylinders in series one by one.

In the above-described first or second embodiment, the abnormal injector diagnosis is performed based on the learning value of the air-fuel ratio feedback correction value. Alternatively, when the output change of the exhaust gas sensor 24 due to the injection ratio changing control can be sensed without being largely affected by the temporary output change of the exhaust gas sensor 24 caused by the noise and the like, the abnormal injector diagnosis may be performed based on the output of the exhaust gas sensor 24 or the air-fuel ratio feedback correction value.

In the above-described first or second embodiment, the abnormal injector diagnosis is performed by performing the injection ratio changing control during the idle operation. Alternatively, for example, the abnormal injector diagnosis may be performed by performing the injection ratio changing control during a steady operation.

In the above-described first or second embodiment, the abnormal injector diagnosis is performed by performing the injection ratio changing control when the rich-side abnormality or the lean-side abnormality of the air-fuel ratio occurs during the engine operation. Alternatively, the abnormal injector diagnosis may be performed by performing the injection ratio changing control during the engine operation regardless of the existence or nonexistence of the abnormality in the air-fuel ratio.

Even if the injection ratio changing control is performed on the cylinder, in which both of the two injectors 21 are normal, the actual sum injection quantity of the two injectors 21 does not change but is substantially constant. Therefore, if the abnormal injector diagnosis is performed by performing the injection ratio changing control during the engine operation regardless of the existence or nonexistence of the abnormality in the air-fuel ratio, the abnormality in the injector 21 can be constantly monitored substantially without adversely affecting the exhaust emission or the drivability.

Figure 10:
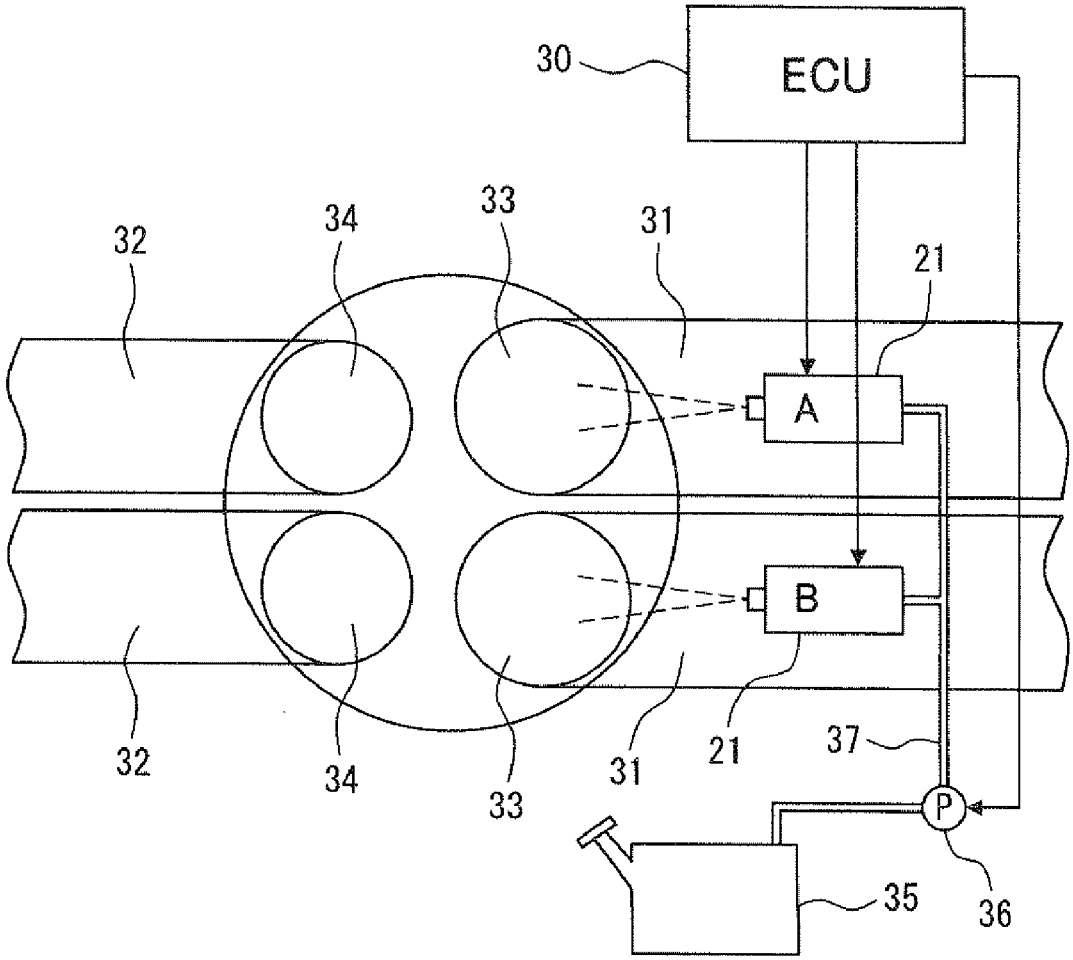
FIG. 10 is a schematic construction diagram showing two injectors provided to one cylinder and a vicinity thereof according to a third embodiment of the present invention.

Next, a third embodiment of the present invention will be described. In the third embodiment, the ECU 30 performs an injector abnormality diagnosis routine of FIG. 11 mentioned in detail later. Thus, when abnormality diagnosis of the injector 21 is performed, the ECU 30 causes the two injectors 21 of each cylinder to perform the injection one by one in a switched manner and determines existence or nonexistence of torque fluctuation (or fluctuation of a combustion state). The ECU 30 specifies an abnormal injector 21 out of the two injectors 21 based on the determination result. Hereafter, one of the two injectors 21 provided to each cylinder is referred to as an injector A, and the other one is referred to as an injector B (refer to FIG. 10).

The injector abnormality diagnosis routine shown in FIG. 11 is executed in a predetermined cycle during the engine operation and functions as an abnormality diagnosing section. If the routine is started, first in S301, it is determined whether an abnormality diagnosis execution condition is satisfied. The abnormality diagnosis execution condition includes (1) a condition that the idle operation (or the steady operation) is in execution, (2) a condition that warming-up of the engine 11 has been completed, (3) a condition that no abnormality is detected in the engine control system except the injectors A, B and the like, for example. The abnormality diagnosis execution condition is satisfied if all the conditions (1) to (3) and the like are satisfied. The abnormality diagnosis execution condition is not satisfied if at least one of the conditions (1) to (3) and the like is not satisfied.

If it is determined in S301 that the abnormality diagnosis execution condition is not satisfied, the routine is ended without performing subsequent processing. If it is determined that the abnormality diagnosis execution condition is satisfied, the process proceeds to S302, where injection of the unilateral injectors A of all the cylinders is permitted, and injection of the other injectors B of all the cylinders is prohibited. The injection of the unilateral injectors A of all the cylinders is performed in series.

Then, the process proceeds to S303, where it is determined whether the torque fluctuation (or the fluctuation of the combustion state) has occurred. As for the determination method of the torque fluctuation (or the fluctuation of the combustion state), for example, the torque fluctuation (or the fluctuation of the combustion state) may be determined based on at least one of a fluctuation amount of the engine rotation speed, cylinder pressure (combustion pressure) sensed with a cylinder pressure sensor (not shown) of each cylinder and the air-fuel ratio of the exhaust gas sensed with the exhaust gas sensor 24. Alternatively, ion current generated with combustion of a mixture gas may be sensed with the spark plug 22 or the like, and the fluctuation of the combustion state may be determined based on the ion current.

If it is determined in S303 that the torque fluctuation (or the fluctuation of the combustion state) has not occurred, the process proceeds to S304, where it is determined that the unilateral injectors A of all the cylinders are normal. If it is determined in S303 that the torque fluctuation (or the fluctuation of the combustion state) has occurred, the process proceeds to S305, where it is determined that the unilateral injector A of the cylinder causing the torque fluctuation (or the fluctuation of the combustion state) is abnormal.

Then, the process proceeds to S306, where the injection of the other injectors B of all the cylinders is permitted, and the injection of the unilateral injectors A of all the cylinders is prohibited. The injection of the other injectors B of all the cylinders is performed in series.

Then, the process proceeds to S307, where it is determined whether the torque fluctuation (or the fluctuation of the combustion state) has occurred using the same method as S303. If it is determined in S307 that the torque fluctuation (or the fluctuation of the combustion state) has not occurred, the process proceeds to S308, where it is determined that the other injectors B of all the cylinders are normal.

If it is determined in S307 that the torque fluctuation (or the fluctuation of the combustion state) has occurred, the process proceeds to S309, where it is determined that the other injector B of the cylinder causing the torque fluctuation (or the fluctuation of the combustion state) is abnormal.

Then, the process proceeds to S310, where it is determined whether both the injectors A, B of all the cylinders are normal. If it is determined that both the injectors A, B of all the cylinders are normal, the process proceeds to S311, where the injection of both the injectors A, B of all the cylinders is permitted, and the routine is ended.

If the result of the determination in S310 is NO, that is, if it is determined that either one of the injectors A, B of certain one of the cylinders is abnormal, the process proceeds to S312. In S312, the injection operation of the injectors in the same positions as the abnormal injector is prohibited on all the cylinders. Then, in following S313, the injection quantity of each of the normal injectors (i.e., each of the injectors permitted to perform the injection) is corrected and increased by the injection quantity equivalent to the injection quantity of the abnormal injector (i.e., the injector prohibited from performing the injection). Thus, the fuel quantity equivalent to the required injection quantity is injected only with the normal injectors (i.e., the injectors permitted to perform the injection). The processing of S312, S313 functions as a fail-safe section.

Figure 12:
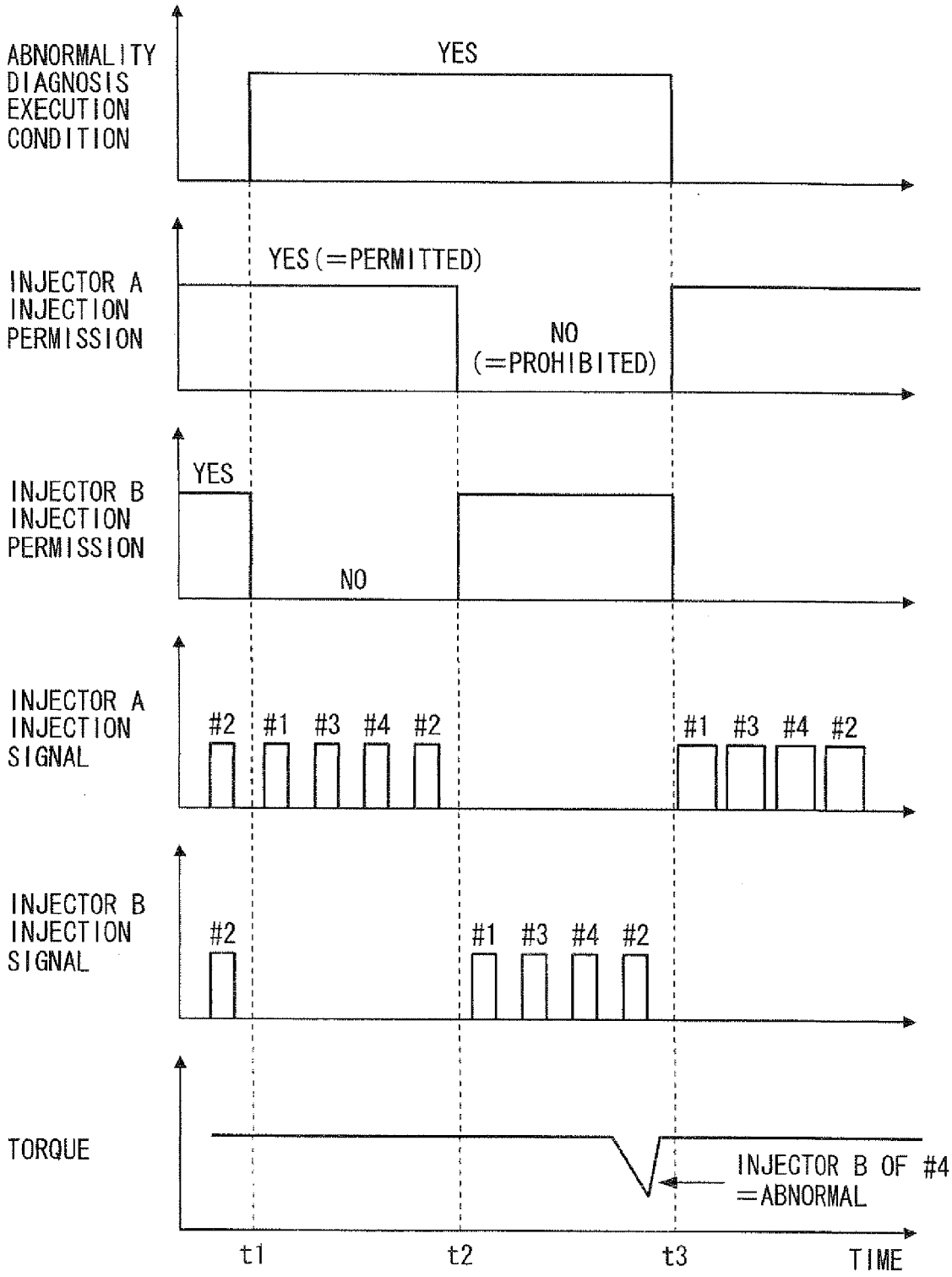
FIG. 12 is a time chart showing a control example at the time when injector abnormality diagnosis is performed according to the third embodiment.

Next, an execution example of the above-described injector abnormality diagnosis routine of FIG. 11 will be described using a time chart of FIG. 12. The example of FIG. 12 shows behaviors of parameters in the case where an injector B of a fourth cylinder #4 of a four-cylinder engine becomes abnormal. In the example of FIG. 12, the abnormality diagnosis execution condition is satisfied and the injector abnormality diagnosis is started at time t1. First, the injection of the unilateral injectors A of all the cylinders is permitted, and the injection of the other injectors B of all the cylinders is prohibited. The injection of the injectors A of all the cylinders is performed sequentially in the order of the first cylinder #1, the third cylinder #3, the fourth cylinder #4, and the second cylinder #2, for example.

At time t2 when the injection of the unilateral injectors A of all the cylinders takes a round, the injection of the unilateral injectors A of all the cylinders is prohibited and the injection of the other injectors B of all the cylinders is permitted. The injection of the other injectors B of all the cylinders is performed sequentially in the order of the first cylinder #1, the third cylinder #3, the fourth cylinder #4, and the second cylinder #2, for example.

The occurrence of the torque fluctuation (or the fluctuation of the combustion state) is monitored during the execution of the injector abnormality diagnosis. For example, if the torque fluctuation (or the fluctuation of the combustion state) is detected in the period in which the injection of the other injectors B is performed, the other injector B of the cylinder (the fourth cylinder #4 in the example of FIG. 12) causing the torque fluctuation (or the fluctuation of the combustion state) is determined to be abnormal.

In this case, the injection operation of the injectors B in the same positions as the abnormal injector B is prohibited on all the cylinders and the injection of only the unilateral injectors A is permitted at time t3 when the injector abnormality diagnosis is ended. In addition, the injection quantity of the normal injector A is corrected and increased by the injection quantity equivalent to the injection quantity of the injector B prohibited from performing the injection.

According to the above-described third embodiment, when the abnormality diagnosis of the injectors 21 (A, B) is performed, the two injectors 21 of each cylinder are caused to perform the injection in a switched manner in turn, and the existence or nonexistence of the torque fluctuation (or the fluctuation of the combustion state) is determined. The abnormal injector 21 is specified out of the two injectors 21 based on the determination result. Accordingly, when the abnormality occurs in either one of the injectors 21, the abnormal injector 21 can be specified.

Moreover, in the present embodiment, when the abnormality occurs in either one of the injectors 21, the injection operation of the injector 21 determined to be abnormal is prohibited and the increase correction of the injection quantity of the remaining injector 21 is performed, thereby injecting the fuel quantity equivalent to the required injection quantity only by the remaining injector 21. Thus, even when either one of the two injectors 21 of each cylinder becomes abnormal, the air-fuel ratio can be controlled to the target air-fuel ratio by injecting the fuel of the quantity equivalent to the required injection quantity only with the remaining injector 21. As a result, the operation of the engine 11 can be continued while suppressing the deterioration of the drivability or the emission.

Furthermore, in the present embodiment, when the abnormal injector 21 is detected in certain one of the cylinders, the injection operation of the injectors 21 in the same positions as the abnormal injector 21 is prohibited on all the cylinders and the fuel is injected from the remaining injectors in the other same positions in all the cylinders. Therefore, a fuel spray form (i.e., a forming state of a mixture gas) of the cylinder having the abnormal injector 21 can be prevented from differing from the fuel spray form of the other cylinders and the fuel spray forms of all the cylinders can be equalized to each other. As a result, the torque fluctuation due to the difference in the fuel spray form among the cylinders can be inhibited.

The application of the present invention is not limited to the system having the two injectors per cylinder. Alternatively, the present invention can be also applied to a system that has three or more injectors per cylinder.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An abnormality diagnosis device of an internal combustion engine provided with a plurality of injectors for each cylinder of the internal combustion engine respectively and with an exhaust gas sensor in an exhaust passage, the abnormality diagnosis device comprising:

an injection ratio changing means for changing a ratio between command injection quantities of the plurality of injectors; and an abnormality diagnosing means for performing injection ratio changing control for changing the ratio between the command injection quantities of the plurality of injectors while keeping the sum of the command injection quantities of the plurality of injectors constant with the use of the injection ratio changing means and for performing abnormal injector diagnosis for specifying an abnormal injector out of the plurality of injectors based on an output of the exhaust gas sensor.

2. The abnormality diagnosis device as in claim 1, wherein the abnormality diagnosing means gradually changes the ratio between the command injection quantities of the plurality of injectors in the injection ratio changing control.

3. The abnormality diagnosis device as in claim 1, wherein the abnormality diagnosing means performs the abnormal injector diagnosis by performing the injection ratio changing control during an idle operation of the internal combustion engine.

4. The abnormality diagnosis device as in claim 1, wherein the abnormality diagnosing means performs the abnormal injector diagnosis by performing the injection ratio changing control during a steady operation of the internal combustion engine.

5. The abnormality diagnosis device as in claim 1, further comprising:

an air-fuel ratio feedback control means for performing feedback correction of an air-fuel ratio based on the output of the exhaust gas sensor, wherein the abnormality diagnosing means performs the abnormal injector diagnosis based on a learning value of an air-fuel ratio feedback correction value provided by the air-fuel ratio feedback control means.

6. The abnormality diagnosis device as in claim 1, further comprising:

an abnormal cylinder specifying means for specifying the cylinder causing an abnormal air-fuel ratio out of a plurality of cylinders of the internal combustion engine, wherein the abnormality diagnosing means performs the abnormal injector diagnosis by performing the injection ratio changing control on the cylinder that is causing the abnormal air-fuel ratio and that is specified by the abnormal cylinder specifying means.

7. The abnormality diagnosis device as in claim 1, wherein the abnormality diagnosing means performs the injection ratio changing control on respective cylinders of the internal combustion engine in series, thereby performing abnormal cylinder diagnosis for specifying the cylinder causing an abnormal air-fuel ratio out of the plurality of cylinders and the abnormal injector diagnosis based on the output of the exhaust gas sensor.

8. The abnormality diagnosis device as in claim 1, wherein the abnormality diagnosing means performs the abnormal injector diagnosis by performing the injection ratio changing control when a rich-side abnormality or a lean-side abnormality of an air-fuel ratio occurs during an operation of the internal combustion engine.

9. The abnormality diagnosis device as in claim 1, wherein the abnormality diagnosing means performs the abnormal injector diagnosis by performing the injection ratio changing control during an operation of the internal combustion engine regardless of existence or nonexistence of an abnormality in an air-fuel ratio.

10. The abnormality diagnosis device as in claim 1, further comprising:

a failsafe control means for prohibiting fuel injection of the abnormal injector and for performing increase correction of fuel injection quantity of the remaining normal injector or injectors when the abnormality diagnosing means specifies the abnormal injector out of the plurality of injectors.

11. An abnormality diagnosis device of an internal combustion engine provided with a plurality of injectors for each cylinder of the internal combustion engine, the abnormality diagnosis device comprising:

an injector switching means for causing the plurality of injectors of each cylinder to perform injection one by one in a switched manner; and an abnormality diagnosing means for determining existence or nonexistence of torque fluctuation or fluctuation of a combustion state by causing the plurality of injectors of each cylinder to perform the injection one by one in a switched manner with the use of the injector switching means and for specifying an abnormal injector out of the plurality of injectors based on a result of the determination when the abnormality diagnosing means performs abnormality diagnosis of the injector.

12. The abnormality diagnosis device as in claim 11, further comprising:

a failsafe means for prohibiting the injection operation of the injector specified to be abnormal by the abnormality diagnosing means and for performing increase correction of injection quantity of the remaining injector or injectors, thereby injecting fuel quantity equivalent to required injection quantity only through the remaining injector or injectors.

13. The abnormality diagnosis device as in claim 12, wherein when the abnormality diagnosing means detects the abnormal injector in certain one of the cylinders, the failsafe means prohibits the injection operation of the injectors in the same positions as the abnormal injector on all the cylinders and performs the increase correction of the injection quantity of the remaining injectors, thereby injecting the fuel only through the remaining injectors.

* * * * *